United States Patent [19]

Pike et al.

[11] 4,432,183

[45] Feb. 21, 1984

[54] ROOFING TILE

[75] Inventors: Robert D. Pike, Lake Placid; Elroy F. Bobolts, Pembroke Pines, both of Fla.

[73] Assignee: Gory Associated Industries, Inc., Ft. Lauderdale, Fla.

[21] Appl. No.: 249,002

[22] Filed: Apr. 3, 1981

[51] Int. Cl.[3] ..... E04D 1/00

[52] U.S. Cl. ..... 52/533; 52/478; 52/543

[58] Field of Search ..... 52/533, 536, 538, 541, 52/542, 543, 553, 560

[56] References Cited

U.S. PATENT DOCUMENTS

| | | | |
|---|---|---|---|
| 426,584 | 4/1890 | Donaldson . | |
| 465,364 | 12/1891 | Donaldson | 52/533 |
| 491,625 | 2/1893 | Watke | 52/533 |
| 592,474 | 10/1879 | Merrill | 52/533 |
| 844,453 | 2/1907 | Donaldson | 52/533 |
| 844,453 | 2/1907 | Johnston . | |
| 1,454,070 | 5/1923 | Openshaw | 52/533 |
| 1,590,744 | 6/1926 | Hatch | 52/542 |
| 2,419,005 | 4/1947 | Bochot | 52/536 |
| 2,510,416 | 6/1950 | Pretty | 52/533 |
| 2,624,298 | 1/1953 | Farren | 52/533 |
| 4,096,679 | 6/1978 | Naz | 52/545 |
| 4,223,490 | 9/1980 | Medow | 52/553 |

*Primary Examiner*—Henry E. Raduazo
*Attorney, Agent, or Firm*—Brumbaugh, Graves, Donohue & Raymond

[57] ABSTRACT

A flat shingle style concrete roofing tile adapted to be laid over an underlayment in a series of courses on a roof and secured to the roof by mechanical fasteners and a sealant is provided. The tile has thickened edges along the front, back and sides molded to the underside of the tile, the front edge and the front portion of the side edges forming a step of reduced thickness relative to the adjacent part of the side edge which is adapted to resist a tile in an upper course from sliding down an inclined roof when engaged with the course immediately below it. The rear portion of the side edges and the back edge being shaped so as to provide an extended bearing surface along the back edge and the rear portion of the side edges of the tile when the tiles are lapped in successive courses. Complementary flanges extending from each side of the tile each form a ridge and a groove, the groove of each tile being adapted to receive and lock the ridge of an adjacent tile. The tile has weep holes molded in the bottom surface of the back edge of the tile located so as to divert the flow of water away from the mechanical fasteners, and to drain water which accumulates between the tile and the underlayment, thereby prolonging the useful life of the underlayment. In another embodiment there is provided a tile for use as the initial course of tile nearest the eaves, the tile having weep holes molded in the bottom surface of a front edge which is thicker than the remaining edges. The thick front edge also properly pitches the tiles, thus obviating the need for raising the fascia or installing a separate filler strip.

4 Claims, 6 Drawing Figures

FIG. 1
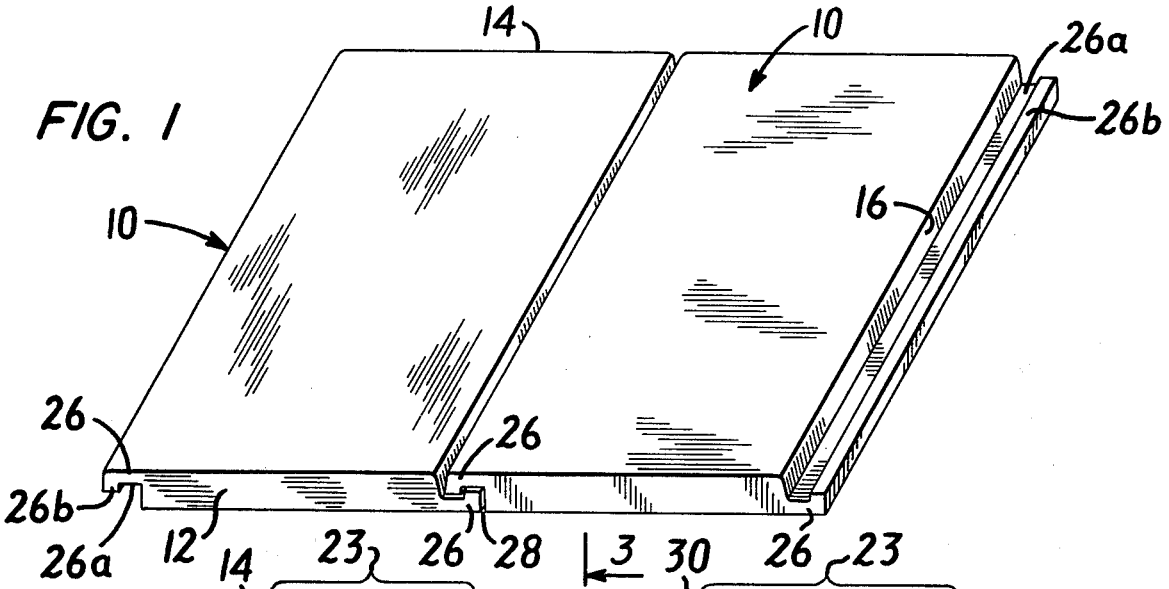
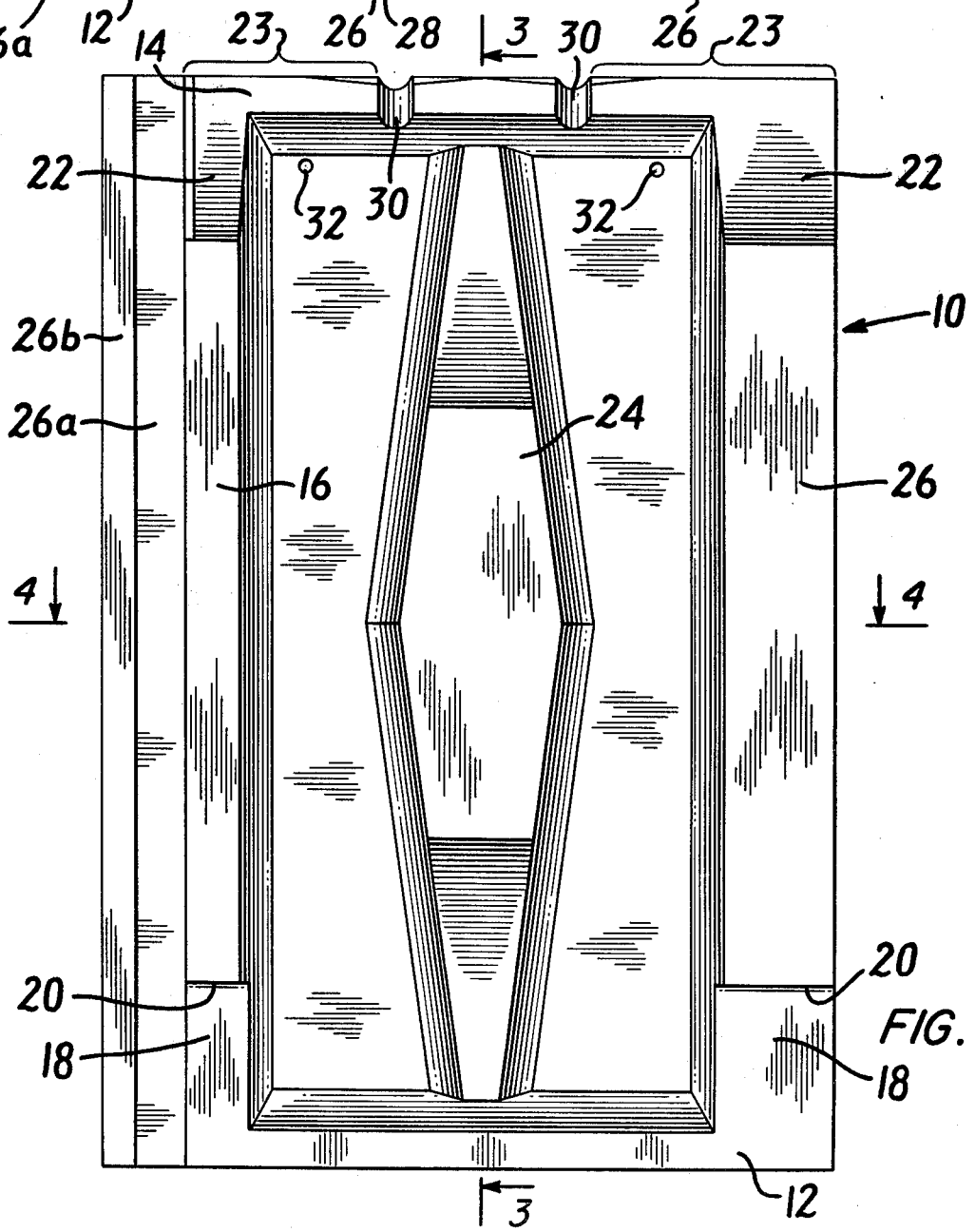
FIG. 2

ROOFING TILE

BACKGROUND OF THE INVENTION

This invention relates to an improvement in roofing tile, and more particularly, to flat shingle style roofing tile having new and improved water drainage features adapted to be laid over an underlayment in a series of rows on a roof.

In prior roofing tile designs, water drainage has been provided along longitudinal gutters formed by lateral flanges used to lock tiles together in transverse rows. Such arrangements are described, for example, in U.S. Pat. No. 592,474 to Merrill and U.S. Pat. No. 2,510,416 to Pretty. Alternatively, other tile designs have incorporated drainage channels on the top surface of the tile, as disclosed, for example, in U.S. Pat. No. 426,584 to Donaldson.

In conventional roofing systems, an underlayment comprising asphalt roofing felt is laid over a plywood underroofing. Wooden strips, or battens, are then laid in transverse rows over the underlayment, and the roofing tiles are nailed, through nail holes provided in the tile, directly to the batten. Some conventional systems secure the tiles to the roof by nailing the tile directly through the asphalt underlayment to the plywood underroofing without using battens.

A disadvantage of these prior roofing tile designs has been the tendency for the ends of the tiles to form dams against the roof underlayment, thereby permitting water to pool on the underlayment. Additionally, the nail holes through the roof underlayment tend to permit the accumulated water to seep beneath the underlayment. Industry experts are in agreement that a major cause for concrete tile roofing system failures has been moisture beneath the tile and the underlayment which is not disappated, and which accelerates the deterioration of the underlayment, leading to roof leaks.

Past roofing tile designs have made no special provisions to prevent the accumulation of water beneath roofing tiles on the roofing underlayment. This has resulted in roofs failing in as early as 12 years, and more commonly in 15 to 20 years. A well-designed and properly installed concrete roofing tile system should last well in excess of 20 years.

Accordingly, it is an object of the invention to provide an improved flat shingle style concrete roofing tile having a new drainage feature which will minimize the accumulation of water beneath the tile, and thereby prolong the useful life of the roof.

It is a further object of the invention to provide a flat shingle style concrete roofing tile wherein no structural considerations will be reflected on the surface of the tile.

SUMMARY OF THE INVENTION

These and other objects of the invention as will become apparent, are accomplished by providing a flat shingle style concrete roofing tile adapted to be laid over an underlayment in a series of rows. The roofing tile is secured to the roof by mechanical fasteners, for example, copper or galvanized nails, driven through nail holes provided near the back edge of the tile, and by a sealant as will be described more fully below. The tile has thickened edges along the front, back and sides molded to the underside of the tile, the front edge, and the front portion of the side edges, having a thickness less than the remaining edges. This area of reduced thickness forms an interlock step which serves several functions. The step primarily serves to resist a tile on an upper row from sliding down an inclined roof, and is also useful in properly aligning the tiles in a transverse row along the roof during installation. Additionally, this step has the added feature of providing a thinner tile, giving the roof a lower thickness profile once the tiles are installed.

As in conventional systems, flanges are provided on opposite sides of the tile, each flange forming a ridge and a groove. As the tiles are laid in a transverse row the groove of a successive tile receives the ridge of a preceding tile. A portion of the back end of the side edges of the tile is sheared off to form a thinner section, or a taper. Because the front end of a successive tile in a longitudinal row is laid over the back end of a preceding tile in that longitudinal row, this tapered end provides a longer bearing surface along the side edges of the tile. This increased bearing length imparts greater structural strength to the tile, yet results in a lighter tile having a thinner cross section. The tile in accordance with the present invention is designed to withstand a minimum load of 300 pounds in conformity with present model building codes.

The tile also is provided with weep holes molded in the back edge of the tile, which are located to drain away water which accumulates between the tile and the underlayment, and to divert such water away from the nail holes in the roofing underlayment. A sealant is applied at the back corners of the tile near the tapered end and the weep holes. Any commonly available sealant used in the roofing trade is suitable. The sealant in the back corners of the tiles prevents water from flowing beneath the tiles along the back edge and directs water to the weep holes. Additionally, sealant may be applied in the region of the nail holes of the tile, and the nails driven through the sealant so that the sealant forms around the nail and prevents water from seeping along the nails through the hole in the roofing underlayment. Thus, the weep holes and the sealant effectively divert water through the weep holes and away from the nails. Water accumulating between the tiles and the underlayment drains along the incline of the roof, underneath each tile, until it abuts the back end of a tile in the next lower course. At the back edge of this preceding tile, the water is diverted through the weep holes and continues down the incline of the roof until it reaches the eaves of the roof. At the eaves, weep holes provided in the front edge of another embodiment of the tile in accordance with the present invention, adapted to be laid as the course of tiles nearest the eaves, permits water to drain off of the roof.

The foregoing and other objects, features and advantages of the invention will become more apparent from the following detailed description of a preferred embodiment of the invention, taken in conjunction with the accompanying drawings.

BRIEF DESCRIPTION OF THE DRAWINGS

FIG. 1 is a perspective view of two roofing tiles in a transverse row in accordance with the present invention;

FIG. 2 is a view of the bottom surface of the tile of the present invention;

DETAILED DESCRIPTION OF THE INVENTION

Figure 3:
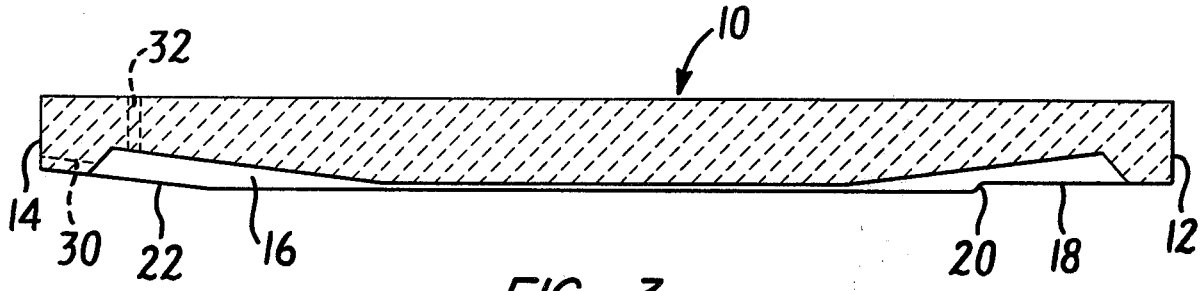
FIG. 3 is a cross-sectional view of the tile on the line 3—3 of FIG. 2.

As shown in FIGS. 2, 3, 4 and 8, there is provided in accordance with the present invention a flat, shingle style concrete roofing tile 10 adapted to be laid over a roofing underlayment 40 in a series of rows. The tile 10 has thickened edges along the front edge 12, the back edge 14, and the side edges 16, 16. The front edge 12, and the front portions 18 of the side edges 16 have a thickness less than the remaining edges, thereby forming a step 20. The step 20 prevents the tiles 10 from an upper row from sliding down the incline of the roof, and maintains the proper alignment of the tiles 10 in a transverse row, particularly during the installation of the roof. The tile may also have a center reinforcing beam 24 to impart reinforcement to the tile.

The side edges 16 also have a sheared back end portion forming a taper 22 which provides an extended bearing surface, when the tiles 10 are overlapped in successive courses.

Figure 4:
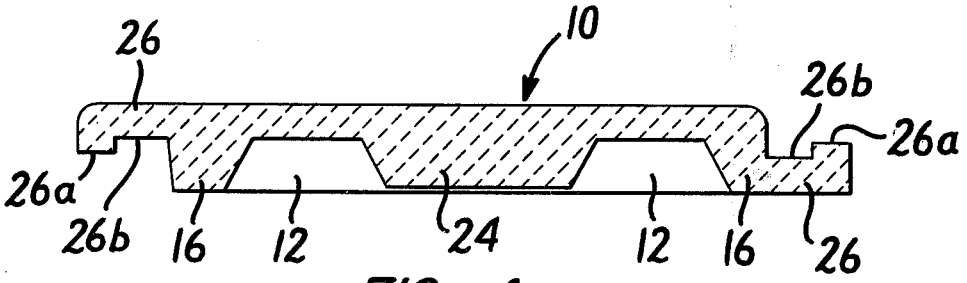
FIG. 4 is a cross-sectional view of the tile on the line 4—4 of FIG. 2.

Complementary flanges 26 extend from each side edge of the tile. As seen in FIGS. 1 and 4, each flange 26 forms a groove **26*a* and a ridge 26*b*, the groove 26*a* of each tile being adapted to receive the ridge 26*b* of an adjacent tile in a transverse row of tiles. A clearance 28 of approximately 1/16" is provided between the grooves 26*a* and the ridges 26*b*** to provide drainage in the conventional manner, and to prevent a capillary from forming which would draw water from the weather surface of the tile to the underlayment.

Weep holes 30 are molded in the bottom surface of the back edge 14 of the tile 10. Nail holes 32 are provided through the tile 10 near the back edge and displaced laterally from the weep holes through which mechanical fastening means, such as copper or galvanized nails, are inserted.

A sealant (not illustrated) is applied at the back corners of the tiles, in the area indicated by brackets 23 and in the area of the nail holes 32, to secure the tile to the roofing underlayment 40. The nails 42 are then inserted through the nail holes 32, the sealant and the roofing underlayment 40 to the underroofing 38. The sealant has the effect of forming a seal along the back edges and around the nail 42, thus preventing water from flowing along the nail and accumulating beneath the underlayment 40.

The positioning of the weep holes 30 themselves, and the sealant, diverts water from the back edge 14 of the tile 10 through the weep holes 30 and away from the nail holes 32, whereby the water travels down the incline of the roof until it abuts the back edge 14 of the preceding tile 10 in the longitudinal row, thereafter traveling through the weep holes 30 of the preceding tile and so on until the water reaches the eaves of the roof.

Figure 5:
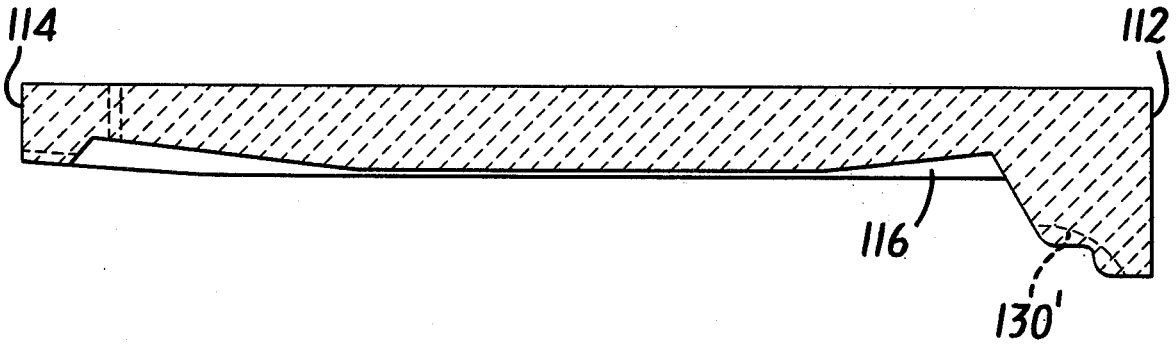
FIG. 5 is a cross-sectional view of a second embodiment of the tile adapted to be used as the initial course of tile nearest the eaves of the roof.
Figure 6:
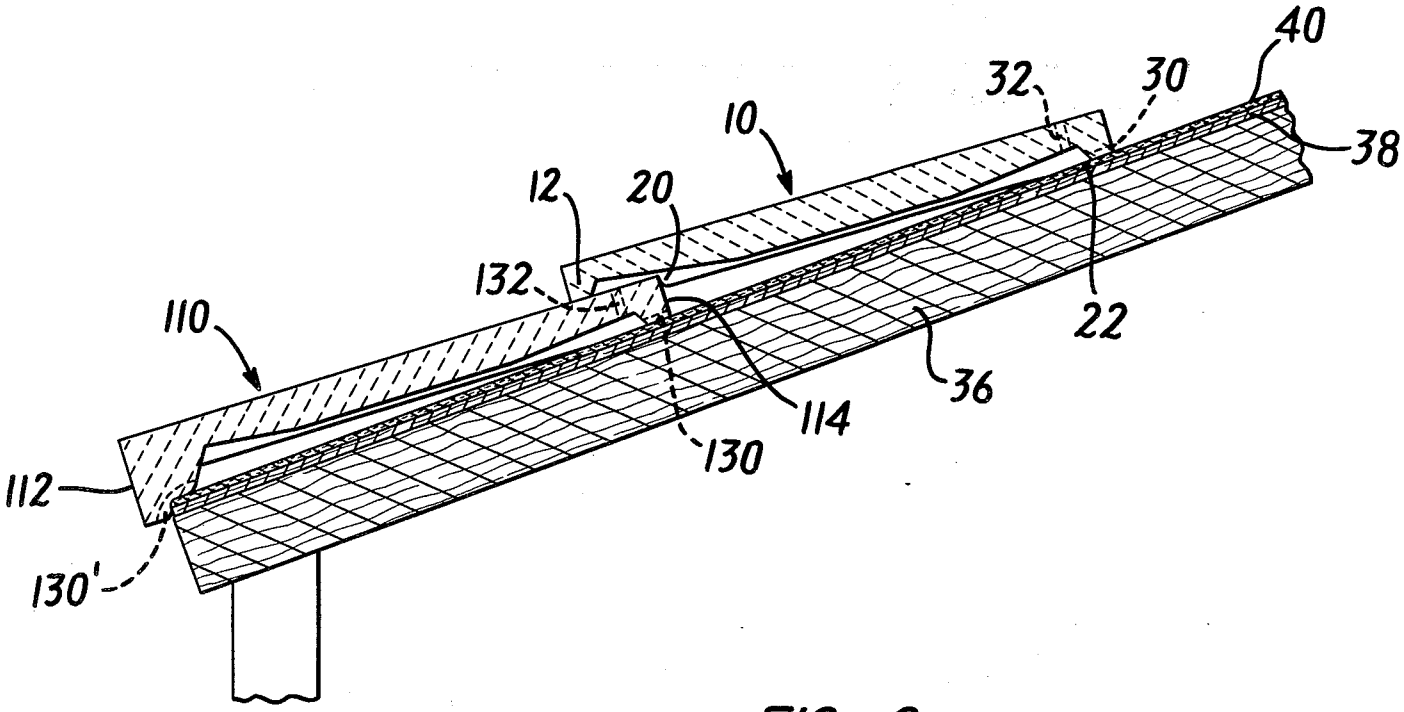
FIG. 6 is a cross-sectional view of a part of a roof constructed in accordance with the present invention.

With reference to FIGS. 5 and 6, there is provided a second embodiment of the tile in accordance with the present invention adapted to be installed as the initial course of tiles nearest the eaves of the roof.

The second tile is substantially similar to the first tile in all respects, except for an extra thick front edge 112. The second tile has a front edge 112 which is approximately 1" thicker than the remaining edges 114, 116. There is provided in the front edge 112 a second set of weep holes 130' to permit water to flow off of the roof. The thick front edge 112 serves to elevate the front end of the tile 110, thus obviating the necessity for raising the fascia to properly pitch the first course of tile, and avoiding what would otherwise be an obvious appearance flaw.

Referring to FIG. 6, a part of a roof is shown constructed in accordance with the present invention comprising conventional supporting or framing, for example, joists 36 over which a plywood roofing deck or underroofing 38 is installed. An underlayment 40 which may be any suitable moisture-resistant barrier such as an asphalt roofing felt is thereafter laid on the underroofing 38. The tiles of the present invention are installed without the aid of battens, although it is to be appreciated that battens could be used.

Beginning at the front edge of the roof near the eaves, after the sealant is applied to the back corners of the tile in the area of the nail holes 132 and taper 122, the thick edge tile is first installed. After the nails are driven through the nail holes 132, the next course of tile 10 is installed, the transverse alignment of the tiles 10 being aided by the step 20, again after the sealant is applied to the back corners of the tile. The process is thereafter repeated for the entire roof.

Although the invention has been described and illustrated herein by reference to specific embodiments thereof, it will be understood that modifications and variations of such embodiments may be made without departing from the inventive concepts disclosed. All such modifications and variations, therefore, and intended to be encompassed within the spirit and scope of the appended claims.

We claim:

1. In a flat shingle style concrete roofing tile adapted to be laid over an underlayment in a series of courses on a roof and fastened to said roof by mechanical fastening means, the tile having thickened edges along the front, back and sides molded to the underside of the tile, a front edge and a front portion of the side edges forming a step of reduced thickness relative to an adjacent part of the side edges which is adapted to resist a tile in an upper course from sliding down an inclined roof when engaged with the course immediately below it, a rear portion of said side edges and the back edge being shaped so as to provide an extended bearing surface along the back edges and rear portion of the side edges of the tile when said tiles are lapped in successive courses, and complementary flanges extending from each side of the tile, each flange forming a ridge and a groove, the groove of each tile being adapted to receive the ridge of an adjacent tile, the improvement wherein; said roofing tile further comprises:

weep holes molded in a bottom surface of said back edge and having beveled areas along said back edge leading into said weep holes, and a sealant being applied at said extended bearing surface, said beveled areas and said sealant being located so as to divert the flow of water through said weep holes and away from said mechanical fastening means and to provide means for draining water which accumulates between the tile and the underlayment, thereby prolonging the useful life of said underlayment.

2. In a flat shingle style concrete roofing tile of claim 1, wherein said tile is adapted to be used as the initial course of tiles nearest the eaves of a roof, said front edge having a thickness greater than said back edge, and said side edges and further comprising weep holes molded in the bottom surface of said front edge to prevent pooling of water at the eaves and provide drainage.

3. In a roof comprising in combination support means, an underroofing, a water resistant underlayment and flat shingle style concrete roofing tile adapted to be laid in a series of courses over an entire roof and fastened to said roof by a sealant and by mechanical fastening means, the improvement wherein:

said roofing tile has thickened edges along the front, back and sides molded to the underside of the tile, the front edge and a front portion of the side edges forming a step of reduced thickness relative to an adjacent part of the side edges which is adapted to resist a tile in an upper course from sliding down an inclined roof when engaged with the course immediately below it, a rear portion of said side edges and the back edge being shaped so as to provide an extended bearing surface along the back edges and a rear portion of the side edges of the tile when said tiles are lapped in successive courses, complementary flanges extending from each side of the tile, each flange forming a ridge and a groove, the groove of each tile being adapted to receive the ridge of an adjacent tile, and weep holes molded in a bottom surface of said back edge and having beveled areas along said back edge leading into said weep holes, and a sealant being applied at said extended bearing surface, said beveled areas and said sealant being located so as to divert the flow of water through said weep holes and away from said mechanical fastening means and to provide means for draining water which accumulates between the tile and the underlayment, thereby prolonging the useful life of said underlayment.

4. A roof according the claim 3 further comprising a tile adapted to be laid as the initial course of tile nearest the eaves of said roof, the front edge of said tile having a thickness greater than said back edge and said side edges, and having weep holes molded in the bottom surface of said thick front edge.

* * * * *